US005165483A

United States Patent [19]

Fox

[11] Patent Number: 5,165,483

[45] Date of Patent: Nov. 24, 1992

[54] DIRECT CONTACT VAPOR GENERATOR FIRE SUPPRESSION APPARATUS

[75] Inventor: Ronald L. Fox, Las Vegas, Nev.

[73] Assignee: Brunswick Corporation, Skokie, Ill.

[21] Appl. No.: 694,117

[22] Filed: May 1, 1991

[51] Int. Cl.[5] ..... A62C 3/06

[52] U.S. Cl. ..... 169/47; 169/12; 169/52; 169/69

[58] Field of Search ..... 169/69, 12, 43, 47, 169/52

[56] References Cited

U.S. PATENT DOCUMENTS 4,113,019 9/1978 Sobolev et al. ..... 169/12

5,046,564 9/1991 Poulsen ..... 169/47

*Primary Examiner*—Margaret A. Focarino

*Assistant Examiner*—Andrew C. Pike

*Attorney, Agent, or Firm*—VanSanten, Hoffman & Ertel Wood, Phillips

[57] ABSTRACT

An improved method and apparatus for controlling large hydrocarbon-fueled fires contemplates the use of vapors produced by direct contact vapor generators to simultaneously cool the flames and deprive the fire of oxygen. A direct contact vapor generator accomplishes fire suppression by surrounding the fire with oxygen-free gases while cooling the flames with water vapor. The direct contact vapor generator is uniquely suited for extinguishing hydrocarbon-fueled fires because of its ability to produce oxygen-free gases and vapor in sufficient quantity to snuff out a fire of the magnitude of those occurring at the sabotaged wellheads in Kuwait in 1991 as well as oil field, oil storage facility, and oil refinery type fires.

17 Claims, 3 Drawing Sheets

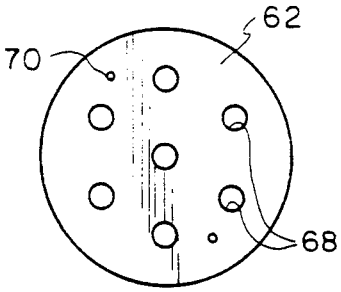
FIG. 6a
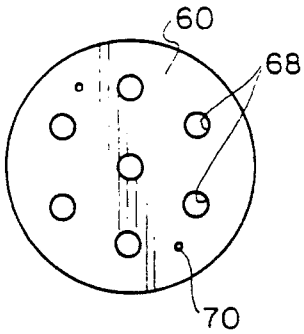
FIG. 6b
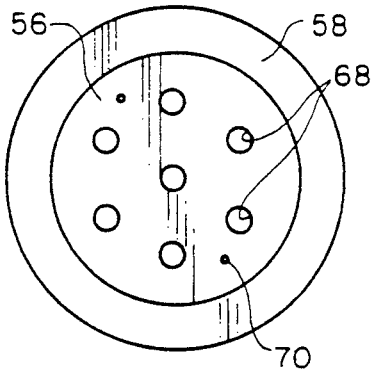
FIG. 6c
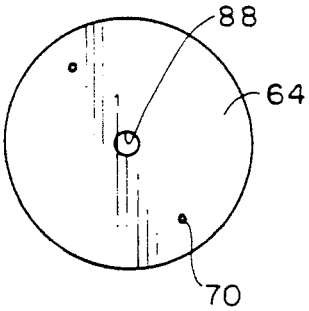
FIG. 6d
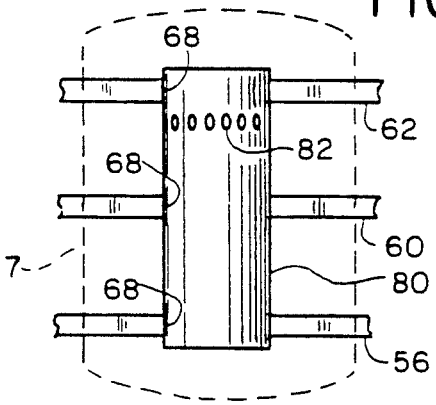
FIG. 7
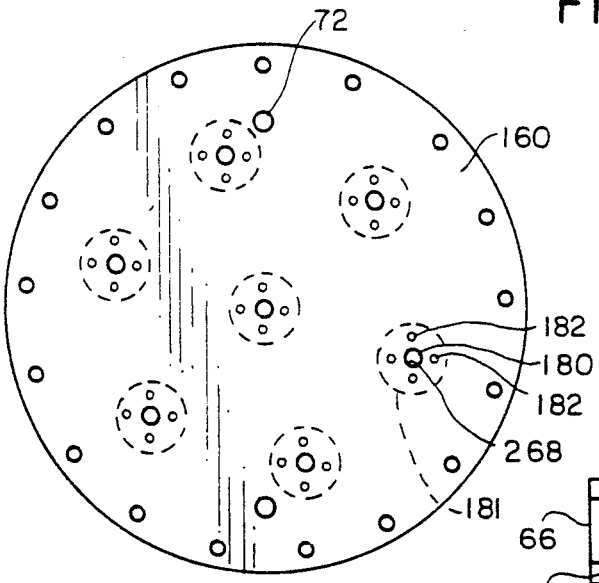
FIG. 9
FIG. 10
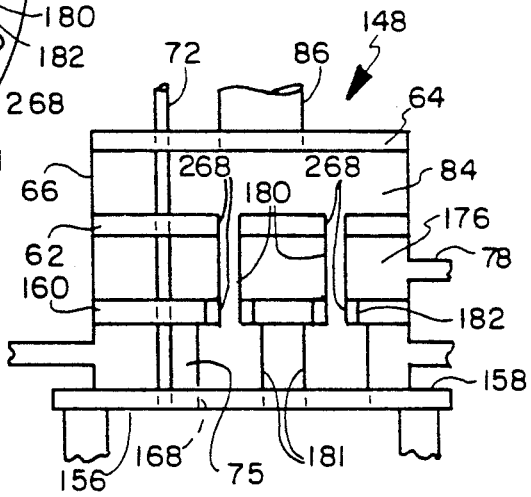

DIRECT CONTACT VAPOR GENERATOR FIRE SUPPRESSION APPARATUS

BACKGROUND OF THE INVENTION

1. Field of the Invention

This invention relates broadly to fire control apparatus and more particularly to apparatus for controlling large fuel fed fires and the like using direct contact vapors.

2. Background Art

The suppression of large hydrocarbon-fueled fires has become a topic of urgent consideration due to the magnitude of oil field fires which are occurring in parts of the world as a result of sabotage Even without sabotage, accidental oil field fires occur resulting in damage to the surrounding community and damage to the environment. Existing methods for extinguishing fires of the type occurring, for instance, in Kuwait in 1991 consisted either in the use of massive amounts of water or in the use of high explosives The use of massive quantities of water is aimed at cooling the flames sufficiently to bring the hydrocarbon fuel below the flash point. The application of high explosives is directed at driving enough oxygen away from the fire such that the fire dies from insufficient oxygen. These two techniques for suppressing oil well fires have been successfully used for several decades. However, the unprecedented magnitude of the fires in Kuwait in 1991 makes it desirable to involve new technology which has the potential to reduce the environmental disaster through the suppression of large hydrocarbon-fueled fires in a rapid and expedient manner.

SUMMARY OF THE INVENTION

An improved method and apparatus for controlling large hydrocarbon-fueled fires contemplates the use of vapors containing steam and oxygen-free gaseous products of combustion produced by direct contact vapor generators to simultaneously cool the flames and deprive the fire of oxygen. A direct contact vapor generator accomplishes fire suppression by surrounding the fire with oxygen-free gases while cooling the flames with vapor that contains water droplets. The direct contact vapor generator is uniquely suited for extinguishing hydrocarbon-fueled fires because of its ability to produce oxygen-free gases and vapor in sufficient quantity to snuff out a fire of the magnitude of those occurring at the sabotaged wellheads in Kuwait in 1991 as well as oil field, oil storage facility, and oil refinery type fires.

The direct contact vapor generator produces a combination of oxygen-free gas and steam which exits the generator in the form of a high pressure vapor stream. Energy for the generator is supplied by either liquid or gaseous hydrocarbon fuels. The fuel is injected into a combustion chamber where it is combined with high pressure air and ignited to yield a high temperature gas. The high temperature gas is oxygen-free, as the oxygen in the air has been utilized to burn the fuel at near stoichiometric conditions. The combustion chamber is centrally located inside the generator and is cooled by a flow of water outside its walls. The water which cools the combustion chamber walls flows into a mixing chamber where it is directly combined with the hot combustion gases. The mixing chamber combines the heated water with the hot gases to produce the vapor mixture of steam and oxygen-free gas which is directed onto the fire, starving the flames of oxygen, thereby extinguishing the flames, and cooling the fuel feeding the fire so as to prevent the fire from reigniting.

Direct contact steam generators have been manufacture for over a decade and have been used primarily for down-hole steam generators in oil well recovery systems. Those generators operate with various hydrocarbon fuels including natural gas, propane, diesel fuel, crude oil, and heavy crude oil. The energy output of these previously manufactured generators ranges from one million to ten million BTU/hour and have been designed to operate at pressures from 100 psi to 3,000 psi. The unique properties of the direct contact vapor generator which lends itself to the suppression of large fires is its ability to produce massive quantities of oxygen-free gas. It has been discovered that direct contact vapor generators can suppress large hydrocarbon-fueled fires rapidly using flow rates which are achievable in practice.

BRIEF DESCRIPTION OF THE DRAWINGS

The accompanying drawings, which are incorporated in and form a part of the specification, illustrate several aspects of the present invention, and together with the description serve to explain the principles of the invention.

IN THE DRAWINGS

Figure 1:
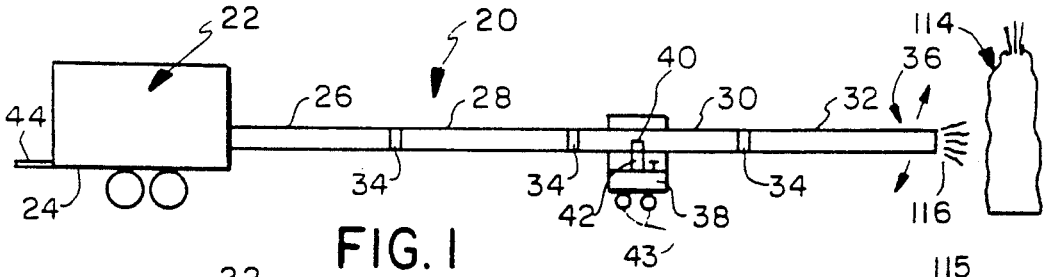
Figure 2:
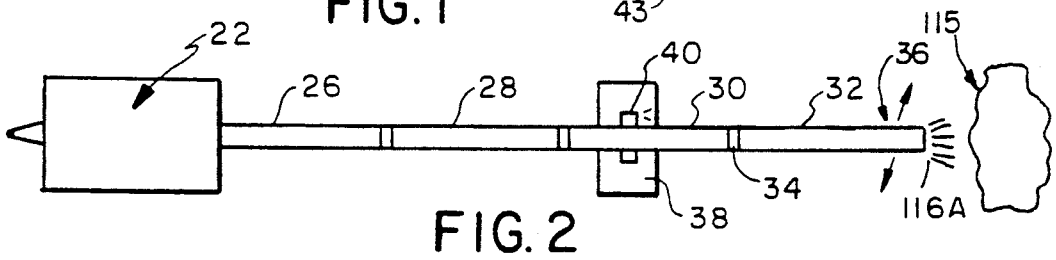
Figure 3:
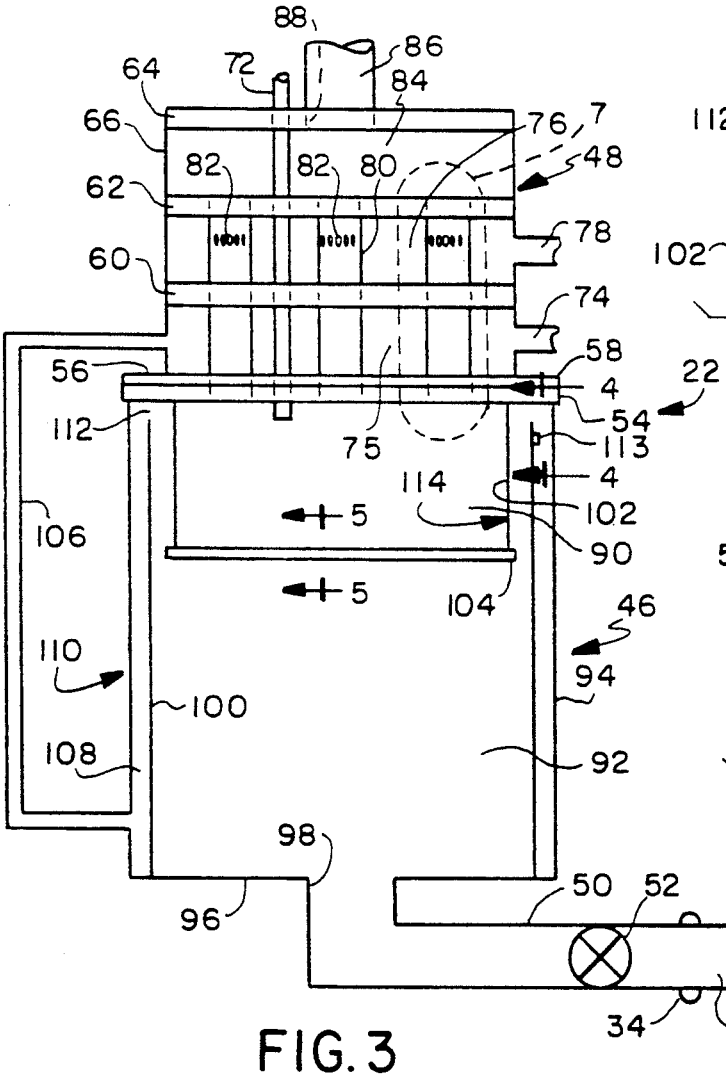
Figure 4:
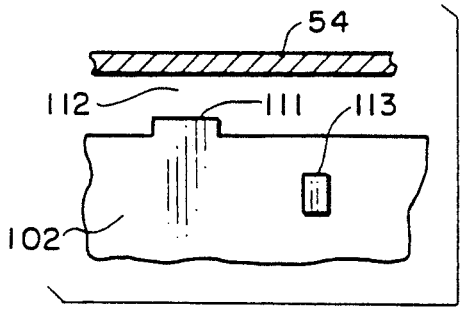
Figure 5:
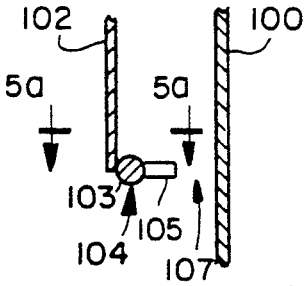
Figure 5A:
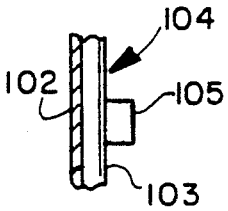
Figure 8:
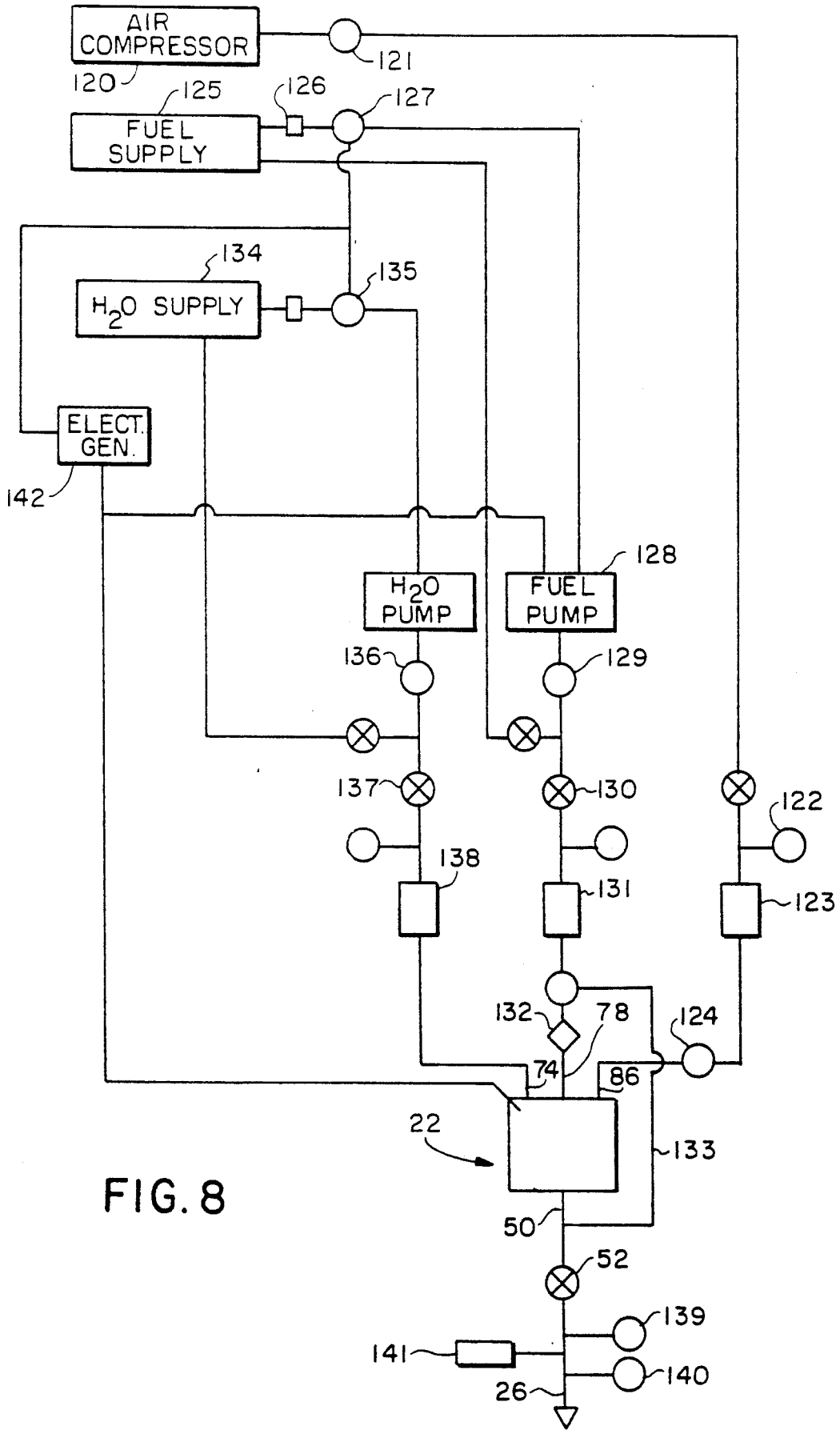

FIG. 1 is an elevational view of a fire control apparatus embodying an improved direct contact vapor generator;

FIG. 2 is a top plan view of the apparatus of FIG. 1 taken along line 2—2;

FIG. 3 is a somewhat schematic elevational view of my improved direct contact vapor generator apparatus;

FIG. 4 is a section taken along the line 4—4 of FIG. 3;

FIG. 5 is a section taken along the line 5—5 of FIG. 3;

FIG. 5*a* is a section taken along the line 5*a*—5*a* of FIG. 5;

FIG. 6*a* is a third plate which forms the divider between the fuel chamber and an air chamber of FIG. 3;

FIG. 6*b* is a second plate which forms the divider between a water chamber and a fuel chamber of FIG. 3;

FIG. 6*c* is a bottom place of the fuel mixing and cooling head section and an air chamber and an air chamber of FIG. 3;

FIG. 6*d* is a top plate of the fuel mixing and cooling head section of FIG. 3 and defines the top wall of the air chamber;

FIG. 7 is an enlarged broken away section of one fuel and air mixing conduit which is delineated by the detail section 7 in FIG. 3;

FIG. 8 is a schematic flow diagram of a typical operative system for generating gases and vapor for fire control using my direct contact vapor generator;

FIG. 9 is a modified form of a second plate, comparable to the second plate shown is FIG. 6*b*, which forms the divider between a water chamber and a fuel chamber and is incorporated in the modified form of fuel mixing and cooling head section shown in FIG. 10; and FIG. 10 is a somewhat schematic elevational view of a modified form of direct contact vapor generator apparatus.

DESCRIPTION OF THE PREFERRED EMBODIMENTS

Referring to FIGS. 1 and 2, my fire control apparatus 20 is illustrated and comprises a direct fired vapor generator 22 mounted on a trailer bed truck 24 to which is connected several pieces of pipe or solid iron tubing 26, 28, 30, and 32. Each piece of pipe could be, for instance, 20 feet in length. Between each piece of the pipe is a coupling 34 which makes it possible to angularly orient one section of pipe relative to its adjacent section of pipe. A separate wheeled vehicle 38 is positioned at an appropriate location along the length of the pipe to support and to direct the pipe outlet 36 in any desired orientation relative to the gas and vapor generator 22. The vehicle 38 includes a hydraulic lift 42 which cradles the pipe in a saddle 40 providing vertical positioning for outer sections of the pipe. The vehicle has all direction type wheels 43 that make it maneuverable back and forth and side to side to provide alignment positioning of the pipe outlet 36. The fire control apparatus 20 including the vapor generator 22, the piping 26, 28, 30, and 32 and the positioning vehicle 38 can be moved from location to location in any well known manner. The apparatus can be connected by the yoke 44 to a full-sized pickup truck or the direct fired vapor generator 22 could be mounted on a standard truck bed. The hydraulic lift on the vehicle 38 can be used to raise o lower the outlet end 36 of the pipe so as to direct the outlet of the pipe accurately into the portion of the flame 114 where the gases and the vapor will be most effective in smothering the flames and cooling the fuel 115 so that it will not reignite. The rate of the output 116 of the vapor generator 22 can be lowered to an output 116A once the flame 114 is extinguished to cool the fuel 115, to cool the surrounding area and prevent rekindling of the flame 114 and maintain a non-burning condition.

Referring to FIG. 3, a direct fired vapor generator 22 is shown somewhat schematically and comprises a base section 46 having a combustion chamber 90, a steam generating chamber 92, and a head section 48 having an air chamber 84, a fuel chamber 76, and a cooling chamber 75. The direct fired vapor generator 22 is preferably vertically disposed although it could be adapted for use at various angles including horizontal. An outlet pipe 50 communicates with the interior of the base section 46 and has a control valve 52 downstream of the outlet for controlling the back pressure of the gases and vapor expelled from the combustion chamber and steam generating chamber. The outlet pipe 50 is connected to the piping 26, 28, 30, and 32, which has been described hereinabove. The base section 46 is connected to the head section 48 by welding or by means of bolts or the like passing through a flange 54 on the top of the base section 46 and a flange 58 on a bottom plate 56 of the head section 48.

The head section 48 consists of a series of plates 56, 60, 62 and 64 with cooling, fuel, and air chambers respectively defined between the plates and enclosed in an outer cylindrical wall 66. The first plate 56 is shown in FIG. *6c* and has the flange 58 for attachment to flange 54 of the base section 46. Plate 56 is sealed to the wall 66 and has seven equally spaced apertures 68 therethrough which communicate into the combustion chamber of the section 46. Plate 56 also has two smaller apertures 70 through which the ignition member 72 such as an ignition plug or the like extends as will be described more fully hereinafter.

Spaced above the plate 56 is the second plate 60, shown in detail in FIG. *6b*, which plate is secured to and sealed to the cylindrical side wall 66. The spacing between plates 56 and 60 defines the water cooling chamber 75 and has a source of water entering thereinto through inlet conduit 74 through the side wall 66. The plate 60 has seven equally spaced apart apertures 68 which are the same size as, and are aligned with, the apertures 68 in the plate 56. Plate 60 likewise has smaller apertures 70 which are aligned with apertures 70 in the plate 56 for passage of the ignition member 72.

The third plate 62 shown in detail in FIG. *6c* is spaced above plate 60 and is secured to and sealed to the side wall 66 to define the fuel chamber 76 between the plates 60 and 62. An appropriate fuel is introduced into the fuel chamber 76 through inlet conduit 78 which extends through the side wall 66. Plate 62 has seven equally spaced apertures 68 aligned with the apertures 68 in plates 60 and 56.

A fourth or top plate 64, shown in detail in FIG. *6d*, is spaced from the plate 62 and is sealed to the cylindrical side wall 66 and defines an air chamber 84 between the plates 4 and 62. An inlet conduit 86 opens into an aperture 88 in the top plate 64 which conduit is connected to an air compressor for conducting compressed air from the compressor into the air chamber 84. Plate 64 has a pair of apertures 70 which are aligned with apertures 70 in plate 62, 60, and 56 in which apertures is disposed the ignition member 72. Seven cylindrical sleeves 80 are seated in the aligned apertures 68 in the plates 62, 60, and 56 with the interior of the sleeves 80 communicating from the air chamber 84 above the plate 6 through the plate 60 and through the plate 56 and open into the combustion chamber 90 in the base section 46.

FIG. 7, which is a detailed section 7 from FIG. 3, is an enlarged view of one of the sleeves 80 and shows how the sleeve 80 is sealed in the openings 68 in the plates 62, 60, and 56. The sleeve 80 has plural ports 82 extending through the side walls thereof in the fuel chamber 76 so that fuel in the fuel chamber 76 may pass through the ports 82 into the interior of the sleeves 80 where the fuel mixes with compressed air flowing from the air chamber 84.

Base section 46 comprises the combustion chamber 90 and the aligned steam generating chamber 92 enclosed in an outer cylindrical wall 94 welded or otherwise secured to the flange 54 at the upper end thereof and at the lower end thereof to a bottom wall 96 through which passes an opening 98 into which is connected the conduit 50 with the control valve 52. Spaced inwardly from the outer wall 94 is a concentric intermediate wall 100 which defines a passageway 108 forming a first water jacket 110. The wall 100 is sealed to the bottom wall 96 and is spaced at the top from the flange 54 to provide a thermal expansion compensating slot 112. Short tabs 111 are formed on the top edge of wall 100 (see FIG. 4) to assure that the passage 112 is kept open. Short lateral lugs 113 are formed on the walls 100 to prevent the water jacket 110 from collapsing. Spaced inwardly from the upper portion of the wall 100 is a concentric cylindrical sleeve 102 which defines a passageway forming a second water jacket 114 which is secured to and sealed against the top flange 54 and has a flow restricter member 104 at the lower outlet edge thereof. The flow restricter 104 (see FIGS. 5 and 5a)

comprises a ring-like member 103 around the lip of the wall 102 with spaced projections 105 extending toward wall 100 to create the desired restriction at the exit 107 of the water jacket 114.

Piping 106 is connected to the cooling chamber 75 in the head section 48 and is connected to the passageway 108 and water jacket 110 near the lower portion of the outer wall 94. Cooling water passes through the cooling chamber 75, through the piping 106 and enters the lower portion of the water jacket 110 of the base section 46 around the outer periphery of the steam generating chamber 92. Water will flow upwardly through the water jacket 110, and through the slot 112 between the end of sleeve 100 and the flange 54. The water will flow down through the cylindrical cooling space of the secondary water jacket 114 between sleeves 102 and 100 around the combustion chamber 90 of the base section 46. The flow restricter 104 will control the volume of heated water passing into the steam generating chamber 92 of the section 46 where the water will contact the gaseous products of combustion from the combustion chamber 90 and be converted to steam. The vapor containing steam and the gaseous products. The vapor will be discharged through outlet conduit 50, control valve 52, and into piping 26, 28, 30, and 32 and into a flame.

Returning to the head section 48, FIGS. 9 and 10 illustrate a modified form of head section 148 wherein parts will that are the same as comparable parts in FIG. 3 have the same reference numerals and parts that have been modified will have different reference numerals. The bottom plate 156 will be identical to plate 56 except for the size of the apertures 168. The apertures 168 in plate 156 are enlarged to receive a slightly larger diameter sleeve 181 which will be sealed in the apertures 168. The sleeves 181 will be welded or sealed to the underside of plate 160. Plate 160 is spaced from plate 156 to form the cooling chamber 75 and is spaced from plate 62 to form the fuel chamber 176. Details of second plate 160 are illustrated in FIG. 9 in enlarged form. Plate 160 and plate 62 have aligned apertures 268 in which are sealed the ends of sleeves 180. The sleeves 181 between plate 156 and plate 160 are welded to the undersurface of plate 160 symmetrically around the apertures 268 and ends of sleeves 180. A plurality of ports 182 are equally spaced from each other and from the outer wall of each sleeve 180 and pass through the plate 160 and into the inside of the sleeves 181 to provide passages for fuel from fuel chamber 176 into the sleeves 181. The fourth or top plate 64 is spaced from plate 62 to define the air chamber 84 and is identical to plate 64 of FIG. 3. The sleeves 180 are seated in the openings 68 in the plate 62 and in the aligned openings 268 in the plate 160 so that the ends of the sleeve 180 open into the air chamber 84 and into the sleeve 181. Igniter members 72 pass through the plates 64, 62, 160, and 156 and extend into the combustion chamber the same as in FIG. 3. Compressed air from a compressor will pass through conduit 86 into the air chamber 84 where it will pass through the conduits 180 and into the sleeves 181. Fuel from fuel chamber 176 will pass through the fuel ports 182 into the sleeves 181 to mix with the compressed air whereupon the air and fuel mix will flow into the combustion chamber 90 where it will be ignited by the ignition member 72.

Returning broadly to the head section 48, both forms of the invention, namely that shown in FIGS. 3 and 10, provide for compressed air entering through conduit 86 into compressed air chamber 84. Compressed air will then pass through sleeve 80 or 180, where, in the case of FIG. 2, fuel will be injected into the compressed air through ports 82 in the sleeves 80, which mix of fuel and air will then be forced into the combustion chamber 90. In the case of FIG. 10, the fuel in fuel chamber 176 will be injected through ports 182 into sleeve 181 where it will mix with the compressed air entering through sleeve 180 with the fuel/air mix then being forced into the combustion chamber 90.

The plate 56 forming the barrier between the cooling chamber 75 and the top wall of the combustion chamber becomes quite hot due to the combustion taking place in the combustion chamber so that the cooling water flowing through chamber 75 picks up heat from the plate 56. The heated water then flows through the piping 106 into the lower portion of the water jacket 110 at the lower part of the steam generating chamber 92. The water flows up through the water jacket 110 on the outer periphery of the steam generating chamber 92 of the base section 46 picking up heat, passes through slots 112, and flows down through the water jacket 114 surrounding the combustion chamber 90 picking up more heat. A certain back pressure is maintained in the combustion and vapor generating section 46 to provide sufficient residence tim=of the fuel and oxidizer in the combustion chamber for complete combustion. The back pressure results from the reduced diameter outlet 98 and by the control valve 52 in conduit 50. The heated water sprays past the flow regulator or flow restricter 104 into the hot gases resulting from the combustion in the combustion chamber 90. The water converts to steam and mixes with the combustion gases in the steam generating chamber 92 to produce vapor. The vapor exits the steam generating chamber 92 through the aperture 98 into the conduit 50 where the vapor will flow through the conduit 26, 28, 30, and 32 into the flame of a fire for smothering the fire and cooling the fuels so as to prevent reignition.

FIG. 8 shows a typical vapor generator flow diagram of the type contemplated to be used herein. An air compressor and storage tanks 120 are connected through a relief valve 121, pressure gauge 122, flow meter 123, conduit 86, and into the air chamber in the head section 48 of the direct fired vapor generator 22. A rupture disk 124 is provided in the line as a safety precaution. A fuel supply 125 is connected to the fuel line 78 into the fuel chamber 76 in the head section 48 of the generator 22 after passing through a fuel filter 126, a booster pump 127, a fuel pump 128, relief valve 129, pressure regulator 130, and fuel flow meter 131. An automatic shutdown 132 is provided with a bypass 133 such that if the flow of fuel is shut down, fuel will bypass the generator 22 and dump into the outlet downstream of the generator. Water from a supply 134 is pumped through a filter and a booster pump 135 where its pressure is increased, through a relief valve 136, through a pressure regulator and gauge 137, through a flow meter 138, and through conduit 74 into the cooling chamber 75 of the head section 48 of the generator 22 with relatively high pressure.

When the system is operating in an area where there is no readily available source of electricity, a gas driven electric generator 142 is mounted on the truck 24 (shown in FIG. 1) which provides electric power to the air compressor, and booster pumps (both fuel and water) so that the air, fuel, and water are delivered to the generator at the proper pressure. The conduit 50 exiting the generator 22 passes through the flow control valve 52 and may have a temperature gauge 139, pressure gauge 140, and an oxygen analyzer 141 connected with said piping 50 so as to monitor the temperature, pressure, and oxygen content of the gas and vapor leaving the generator.

It is contemplated, based on simulated tests, that the volume of vapor capable of being readily generated will be sufficient to instantaneously extinguish oil fires burning at wellheads gushing approximately 5,000 barrels a day using a single direct fired vapor generator 22 with a single outlet 36 pumping vapors and gases into the flames. Although several small generators 22 could be used in parallel, it is preferred to use one or two larger generators 22, 22 because of the reduced manpower requirements when fewer units are in operation. Initially, symmetrically arranged generators 22 hitting the fire from different quadrants was contemplated, but as a result of the tests it has been determined that a single injection of vapors and gases has worked successfully. The tests have shown that the fire is rapidly extinguished when contacted by the vapors and gases coming from any direction.

Assume for calculation purposes that a fire is burning at a wellhead that is spewing 5,000 barrels a day of crude oil into the flame. Using established formulas it has been calculated that a direct fired vapor generator must produce an energy output of 60 million BTU/-hour. Such a generator 22 can be run on propane, natural gas, diesel fuel, and various grades of crude oil of 12° API gravity. This particular generator running on diesel fuel requires 300 gallons/minute of water, 9 gallons/minute of diesel fuel and 1,800 cubic feet/minute of air. The air compressor is a 100 psi model. Ignition is supplied from a compositor discharge spark system. Once the combustion in the combustion chamber of the generator has been started, it is self-perpetuating and the ignition system is turned off. If there is no water source immediately available, the water can be carried to the site in a tank truck. Beyond coarse filtering, the water does not have to be treated as a sufficient amount of liquid phase water is maintained in the vapors to carry away particulates and water hardness.

A method for extinguishing a fuel fed fire requires an initial determination of the amount of fuel feeding the fire so that the operator can be sure that the direct contact vapor generator is of a size sufficient to snuff out the flames and keep them suppressed. A generator of 60 million BTU/hour should be adequate for most fires. The output of the generator is intended to provide an overwhelming force for any fire within the designated operating range. The output of the generator 22 is applied full force against the fire to provide for instantaneous suppression. The output of the generator 22 may be reduced to direct vapors on the smoldering source at a greatly reduced rate in order to prevent reflashing.

The embodiment was chosen and described in order to best explain the principle of the invention and its practical application to thereby enable others skilled in the art to best utilize the invention in various embodiments and with various modifications as are suited to the particular use contemplated. It is intended that the scope of the invention be defined by the claims appended hereto

I claim:

1. A direct fired vapor generator for fire suppression that uses both water and gaseous products of combustion from a fuel/air mix to create a vapor that contains steam and the gaseous products, the vapor being capable of extinguishing a flame of a fuel fed fire and maintain fuel that had been feeding the fire in a non-burning condition, the direct fired vapor generator comprising:

(a) a combustion chamber capable of producing the gaseous products from the fuel/air mix, the combustion chamber being defined by a top and side sleeves;

(b) a steam generating chamber aligned with the combustion chamber;

(c) a head section mounted on the combustion chamber, said head section having defined therein
  (i) a compressed air chamber,
  (ii) a fuel chamber, and
  (iii) a cooling chamber, said cooling chamber being adjacent to said combustion chamber;

(d) ignition means carried by the head section and projecting into the combustion chamber;

(e) means for delivering the fuel/air mix into the combustion chamber;

(f) a first water jacket surrounding the combustion chamber and the steam generating chamber, the first water jacket having a fluid connection to the cooling chamber for cooling the top of the combustion chamber and for cooling the steam generating chamber;

(g) a second water jacket in fluid communication with the first water jacket and surrounding the combustion chamber for cooling the side sleeves of the combustion chamber;

(h) means for injecting the water from the second water jacket into the steam generating chamber to vaporize the water with the gaseous products of combustion produced in the combustion chamber to form the vapor containing the steam and the gaseous products; and (i) means for discharging the vapor into the flame to extinguish the flame and to maintain the non-burning condition.

2. The direct fired vapor generator of claim 1 wherein the cooling chamber in said head is comprised of spaced apart plates with one plate forming a common wall between the cooling chamber and the combustion chamber wherein the spaced apart plates can direct the water through the cooling chamber to cool the top of the combustion chamber and pick up heat from the combustion chamber thereby producing warmed cooling water in the cooling chamber.

3. The direct fired vapor generator of claim 2 wherein the warmed cooling water from the cooling chamber is directed into a lower portion of the first water jacket surrounding the steam generating chamber, and said warmed cooling water is directed up through the first water jacket to pick up heat from the steam generating chamber thereby producing heated water in the first water jacket.

4. The direct fired vapor generator of claim 3 wherein the heated water is directed into the second water jacket surrounding the combustion chamber to pick up additional heat from the combustion chamber.

5. A direct fired vapor generator of claim 4 wherein the means for injecting the water is mounted at an exit of the second water jacket, said injecting means being capable of creating back pressure in the water jackets and spraying the heated water into the gaseous products generated by the combustion of the fuel/air mix in the combustion chamber.

6. The direct fired vapor generator of claim 1 wherein the generator is capable of extinguishing the flame of the fire fed by the fuel spewing at a rate of about 5,000 barrels a day.

7. A direct fired vapor generator for fire suppression that uses both water and gaseous products of combustion form a fuel/air mix to create a vapor containing steam and the gaseous products, the vapor being capable of extinguishing a flame of burning fuel and maintain the fuel that had been burning in a non-burning condition, the direct fired vapor generator comprising:

(a) a base section having a combustion chamber and an aligned steam generating chamber, a fuel chamber, and a cooling chamber, the cooling chamber being adjacent to the combustion chamber, the combustion chamber being capable of producing the gaseous products of combustion;

(b) a head section mounted on the base section adjacent the combustion chamber, the head section defining a compressed air chamber;

(c) ignition means carried by the head section and projecting into the combustion chamber;

(d) cooling means surrounding the base section and having a fluid connection to the cooling chamber for cooling the combustion chamber and the steam generating chamber;

(e) means for injecting the water from the cooling means into the steam generating chamber that is capable of being converted into the steam to produce the vapor that contains the steam and the gaseous products of combustion; and (f) means for discharging the vapor into the flame to extinguish the flame by oxygen starving the flame and to maintain the non-burning condition by cooling the fuel that had been burning using the vapor.

8. The direct fired vapor generator as claimed in claim 7 wherein sleeve means between the air chamber and the combustion chamber pass through the fuel chamber, the sleeve means defining therein port means into the sleeve means capable of passing fuel for the fuel/air mix into air in the sleeve means to provide the fuel/air mix for ignition by the ignition means in the combustion chamber, the sleeve means having a wall.

9. The direct fired vapor generator as claimed in claim 8 wherein the port means extend through the wall of the sleeve means in the fuel chamber.

10. The direct fired vapor generator as claimed in claim 8 wherein the sleeve means has an enlarged diameter portion between the fuel chamber and the combustion chamber where the sleeve means passes through the cooling chamber, and wherein the port means extend through a plate means separating the fuel chamber from the cooling chamber and open into the enlarged diameter portion of the sleeve means.

11. The direct fired vapor generator as claimed in claim 8 wherein the cooling means surrounding the base section comprises a first water jacket surrounding both the steam generating chamber and the combustion chamber and a second water jacket in flow communication with the first water jacket and surrounding only the combustion chamber, the second water jacket having an exit and flow regulator means at the exit for discharging the water into the gaseous products of combustion from the combustion chamber for creating the vapor.

12. The direct fired vapor generator of claim 7 wherein the generator is capable of extinguishing the flame of fire fed by the fuel spewing at a rate of about 5,000 barrels a day.

13. A direct fired vapor generator for fire suppression that uses both water and gaseous products of combustion of a fuel/air mix to create a vapor that contains steam and the gaseous products, the vapor being capable of smothering a fire of burning fuel and cooling the fuel that was burning to prevent reflashing of the fire, the gaseous products being substantially oxygen free, the direct fired vapor generator comprising: a fuel mixing and cooling head, a combustion chamber operatively associated with said head, and a steam generating chamber directly aligned with said combustion chamber;

(A) said fuel mixing and cooling head comprising (a) an air chamber capable of containing air, (b) means for supplying compressed air to said air chamber, (c) a fuel chamber capable of containing fuel, (d) means for supplying the fuel of the fuel chamber to said fuel chamber, (e) a cooling chamber capable of containing the water, (f) means for supplying the water to said cooling chamber, (g) sleeve means communicating between the air chamber and the combustion chamber and passing through the fuel chamber and the cooling chamber for conveying the air to the combustion chamber, (h) means for directing the fuel from the fuel chamber into the sleeve mans for mixing the fuel with the air to provide the fuel/air mix for the combustion chamber, and (i) ignition means in the combustion chamber for igniting the fuel/air mix entering the combustion chamber and producing the substantially oxygen-free combustion products;

(B) said combustion chamber and said aligned steam generating chamber comprising:

(a) a vertically oriented outer wall having an upper end, a lower end, and a bottom wall, the outer wall being sealed to the cooling head at the upper end of the outer wall and sealed at the lower end to the bottom wall of the outer wall, the bottom wall defining an outlet therein;

(b) a second wall spaced inward of the outer wall to define a first water jacket therebetween, the second wall having an upper end, said second wall being sealed to the bottom wall at the upper end of the second wall and having a flow passage between the upper end of said second wall and the cooling chamber, the second wall further defining the steam generating chamber;

(c) an inner wall spaced inward from the second wall and defining sides of said combustion chamber, said inner wall being sealed to said cooling head to form a second water jacket with respect to the second wall, a length of said inner wall being less than a length of the second wall;

(d) means for connecting said cooling chamber in the head with a lower portion of the first water jacket whereby the water can flow across a top of the combustion chamber, through the first water jacket to cool the steam generating chamber, and then through the second water jacket to cool the sides of the combustion chamber while picking up heat from said combustion chamber to produce heated water in the second water jacket; and (e) flow regulator means at an exit of the second water jacket for controlling flow of the heated water into the steam generating chamber where said heated water is vaporized by the substantially oxygen-free combustion products to produce the vapor containing the steam and the gaseous products, said vapor being capable of being directed into the fire and cool the burning fuel thereby preventing reflashing of the fire.

14. The direct fired vapor generator of claim 13 wherein the generator is capable of extinguishing a flame of the fire fed by the fuel spewing at a rate of about 5,000 barrels a day.

15. A direct fired vapor generator for fire suppression that uses both water and gaseous products of combustion of a fuel/air mix to create a vapor that contains steam and the gaseous products, the vapor being capable of smothering a fire of burning fuel and cooling the fuel that was burning to prevent reflashing of the fire, the gaseous products being substantially oxygen free, the direct fired vapor generator comprising a head section, and a base section, the base section having a combustion chamber and a steam generating chamber directly aligned with said combustion chamber, wherein (A) said head section comprises (a) an air chamber capable of containing air, (b) a fuel chamber capable of containing fuel adjacent to said air chamber, (c) a cooling chamber between the fuel chamber and the combustion chamber with a common wall therebetween, the cooling chamber being capable of containing the water, (d) sleeve mans communicating between the air chamber and the combustion chamber and passing through the fuel chamber and the cooling chamber capable of conveying the air to the combustion chamber, (e) means for directing the fuel from the fuel chamber into the sleeve means for mixing the fuel with the air to provide the fuel/air mix to the combustion chamber, and (f) ignition means in the combustion chamber for igniting the fuel/air mix entering the combustion chamber, and (B) said base section further comprising (a) a first water jacket surrounding said base section and being in fluid communication with the cooling chamber of the head section, (b) a second water jacket interior of the first water jacket and surrounding only the combustion chamber, said second water jacket being in fluid communication with the first water jacket, and (c) flow regulator means at an outlet of the second water jacket for discharging the water form the water jackets into the gaseous products of combustion from the combustion chamber to form the vapor containing the steam and said gaseous products of combustion, wherein the vapor can be discharged into a flame of the fire to extinguish the fire and prevent the fire from reflashing.

16. The direct fired vapor generator of claim 15 wherein the generator is capable of extinguishing a flame of the fire fed by the fuel spewing at a rate of about 5,000 barrels a day.

17. A method of extinguishing a fire fed by a fuel using vapor containing substantially oxygen-free gas and steam so the fire fuel is now non-burning fuel, the fire having a flame and a base of the flame, the method comprising maneuvering a vehicle upon which is mounted a direct fired vapor generator into position to align an outlet pipe close to the flame, the outlet pipe having an end, raising or lowering the outlet end of the pipe to direct the pipe toward the base of the flame, moving the outlet end of the pipe left or right to further align the outlet end with the base of the flame, operating the direct fired vapor generator at a high output for pouring a high volume of the vapor into the flame to rapidly snuff out the flame, and lowering the output of the direct fired vapor generator to continue to direct a lower volume of the vapor into the now non-burning fuel to cool the non-burning fuel and the surrounding area thereof so as to prevent rekindling of the flame.

* * * * *